US008807586B2

(12) United States Patent
Lehner et al.

(10) Patent No.: US 8,807,586 B2
(45) Date of Patent: Aug. 19, 2014

(54) FRONT UNIT FOR A SLIDING BOARD BINDING, IN PARTICULAR A PIVOTABLE FRONT UNIT COMPRISING A RELEASE ARRANGEMENT

(71) Applicant: Salewa Sport AG, Herisau (CH)

(72) Inventors: Edwin Lehner, Gilching (DE); Fredrik Andersson, Feldkirchen (SE)

(73) Assignee: Salewa Sport AG, Herisau (CH)

( * ) Notice: Subject to any disclaimer, the term of this patent is extended or adjusted under 35 U.S.C. 154(b) by 0 days.

(21) Appl. No.: 13/870,019

(22) Filed: Apr. 25, 2013

(65) Prior Publication Data

US 2013/0285352 A1 Oct. 31, 2013

(30) Foreign Application Priority Data

Apr. 25, 2012 (DE) ..... 10 2012 206 880

(51) Int. Cl.
*A63C 9/00* (2012.01)

(52) U.S. Cl.
USPC ..... 280/611

(58) Field of Classification Search
USPC ..... 280/611–618
See application file for complete search history.

(56) References Cited

U.S. PATENT DOCUMENTS

| | | | | |
|---|---|---|---|---|
| 5,915,721 | A * | 6/1999 | Laughlin et al. | 280/617 |
| 7,490,859 | B2 * | 2/2009 | Coing | 280/817 |
| 7,661,695 | B2 * | 2/2010 | Miette | 280/623 |
| 7,887,084 | B2 * | 2/2011 | Howell | 280/628 |
| 8,544,869 | B2 * | 10/2013 | Lehner | 280/611 |
| 2011/0025003 | A1 | 2/2011 | Moore et al. | |

FOREIGN PATENT DOCUMENTS

| | | | |
|---|---|---|---|
| CH | 705579 | A2 | 4/2013 |
| DE | 19703942 | A1 | 8/1998 |
| EP | 0552468 | A1 | 7/1993 |

* cited by examiner

*Primary Examiner* — John Walters
*Assistant Examiner* — James Triggs
(74) *Attorney, Agent, or Firm* — Rothwell, Figg, Ernst & Manbeck, P.C.

(57) ABSTRACT

The invention provides a front unit (10) for a sliding board binding, comprising a base (14), which is set up for fastening to a sliding board and which defines a sliding board plane (E), and a front holding means for holding a front portion of a sliding board boot (12), the front holding unit being mounted rotatably on the base (14) so as to make rotation both of the front holding means and of the sliding board boot (12) possible about a shared vertical axis, extending substantially orthogonal to the sliding board plane (E), in a closed position of the front holding means. The front unit (10) further comprises a release arrangement (84, 86) which converts a relative movement of the holding means and the base (14) into an adjustment movement of the holding means from the engagement position into a release position.

14 Claims, 4 Drawing Sheets

Figures 2A, 2B, 2C, 2D, 2E:
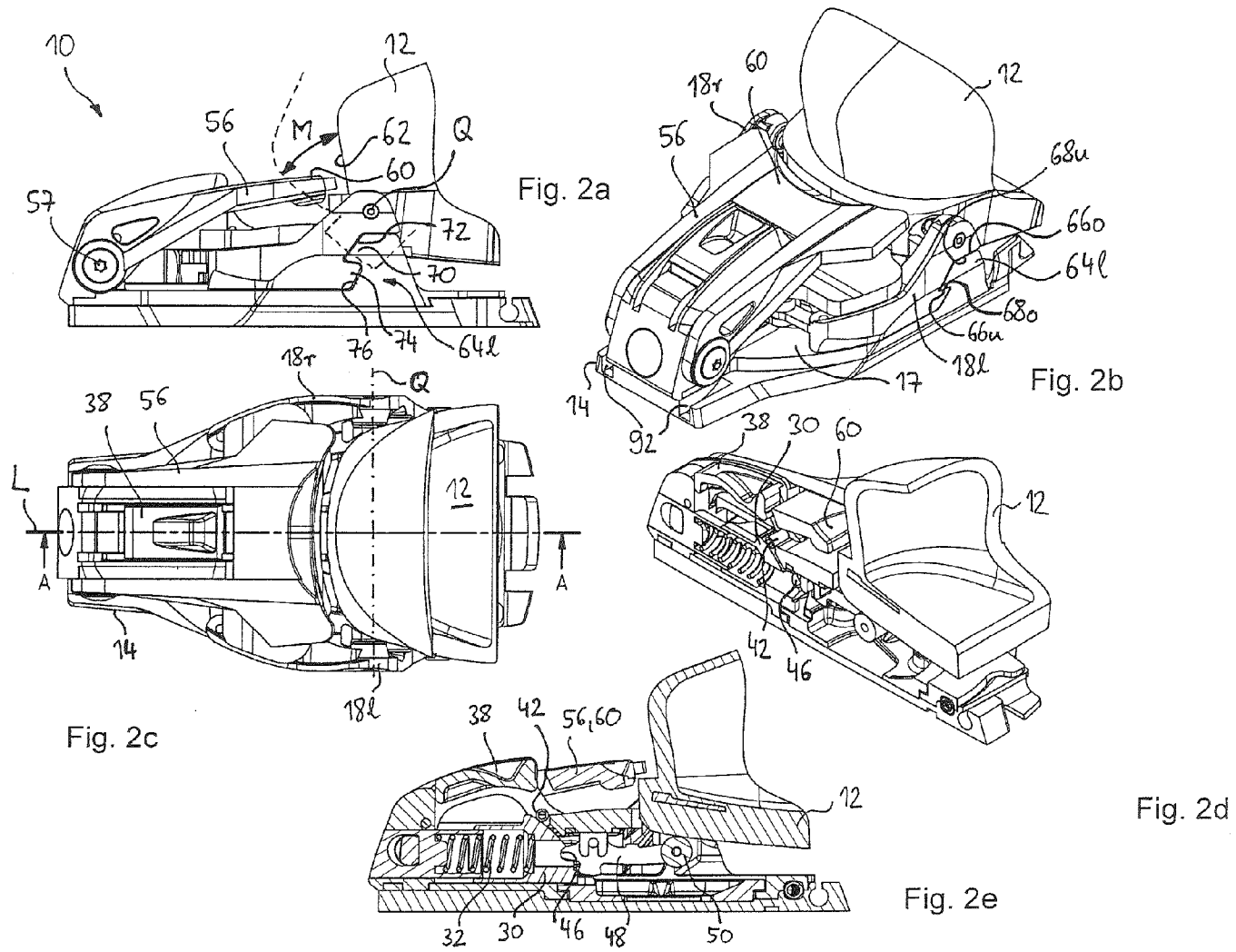
Figures 3A, 3B, 3C, 3D, 3E:
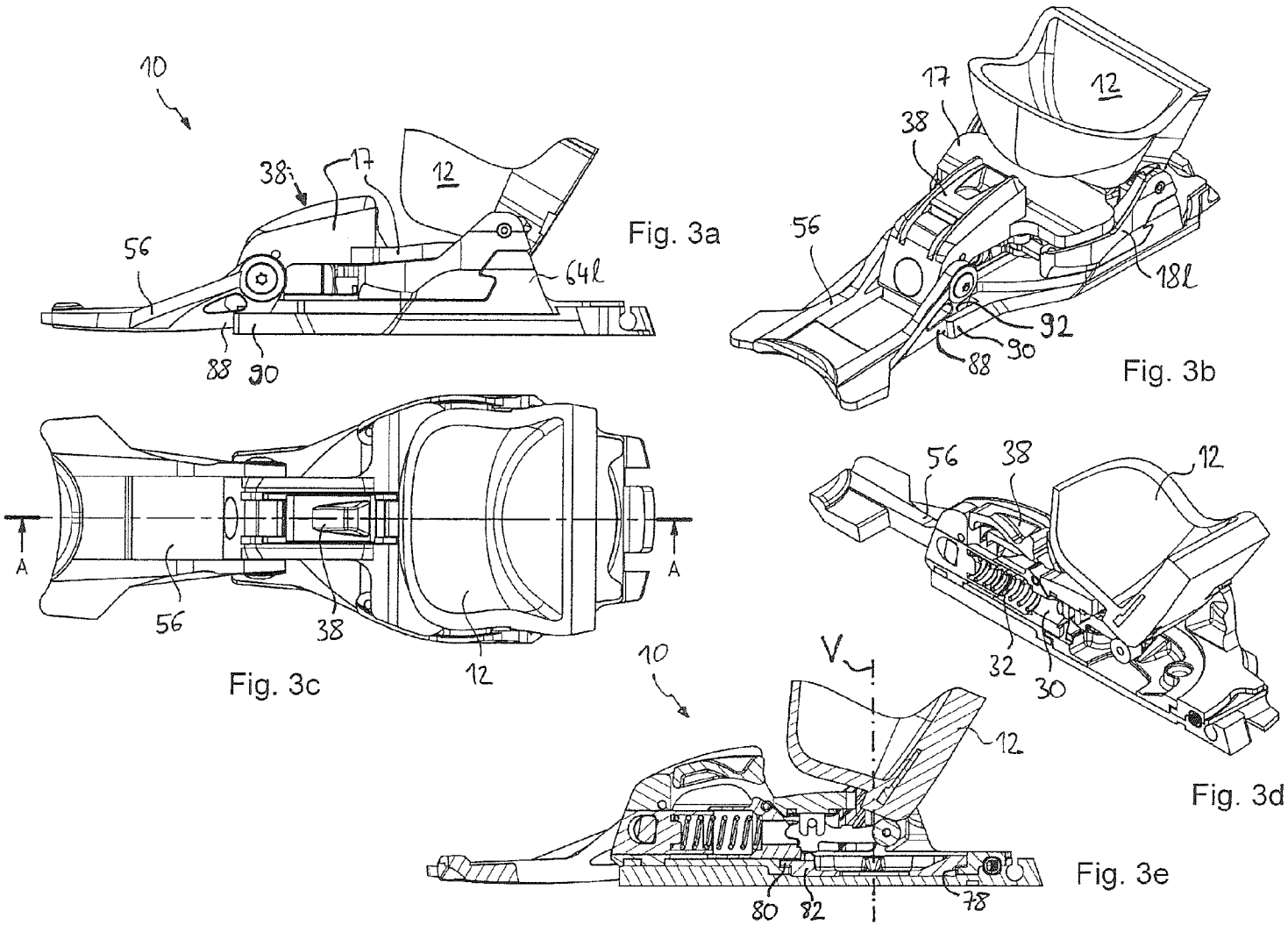

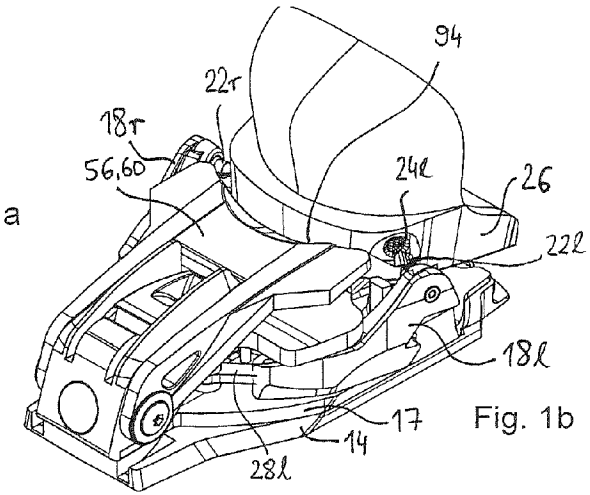
Fig. 1a
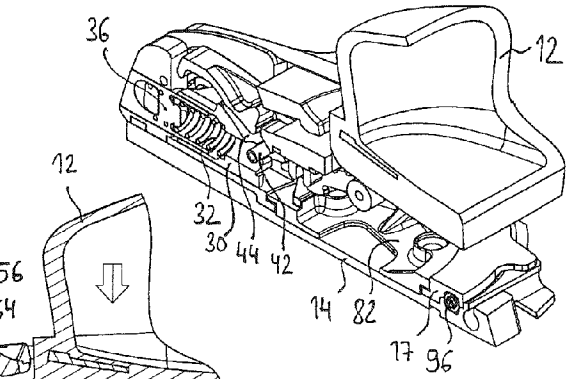
Fig. 1b
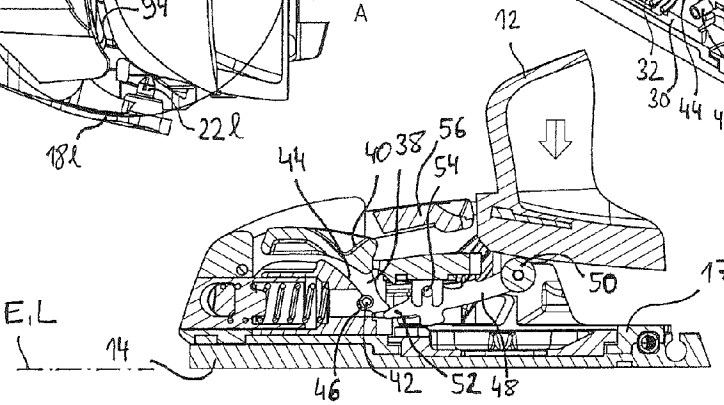
Fig. 1d
Fig. 1e
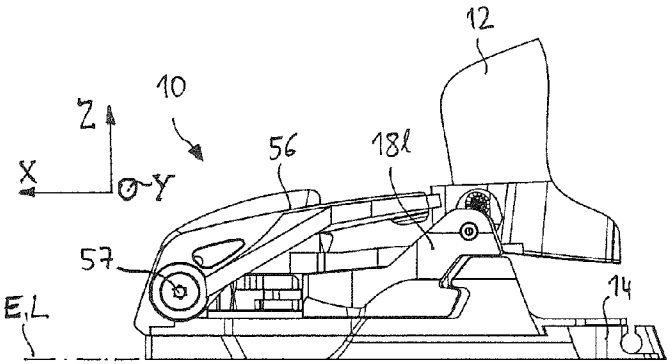
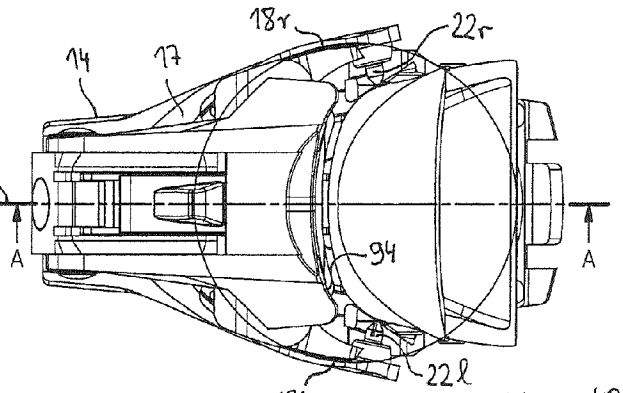
Fig. 1c 12
18l
92
90
88
17
38
56

12
38
56
32
30

12
78
V
82
80
10

10
64l
12
17
38
90
88
56

A
12
38
56
A

FRONT UNIT FOR A SLIDING BOARD BINDING, IN PARTICULAR A PIVOTABLE FRONT UNIT COMPRISING A RELEASE ARRANGEMENT

CROSS REFERENCE TO RELATED APPLICATION

This application claims the benefit of German Patent Application No. 10 2012 206 880.5 filed on Apr. 25, 2013, the disclosure of which is incorporated herein in its entirety by reference.

In accordance with a first aspect, the present invention relates to a front unit for a sliding board binding, comprising a base, which is set up for fastening to a sliding board and which defines a sliding board plane, and a front holding means for holding a front portion of a sliding board boot, the front holding means being mounted rotatably on the base so as to make rotation both of the front holding means and of the sliding board boot possible about a shared vertical axis, extending substantially orthogonal to the sliding board plane, in an engagement position (for example a downhill position or a touring position) of the front holding means.

A front unit of this type is known from EP 2 431 080 A1. The rotatable mounting of the holding means about a vertical axis of rotation makes possible a shared rotation of the holding means and of the ski boot which is held thereon in the event of lateral release of the binding (Mz release). In the known binding, the release takes place in two steps, the heel unit of the binding releasing the heel portion of the boot in a first step, in such a way that the boot can pivot freely about the vertical axis together with the holding means of the front unit, and the shared pivoting movement of the holding means and the boot being stopped abruptly against a stop in a second step, whereupon the boot also springs out of the front unit as a result of the acting inertia forces.

The conventional binding has the drawback that, because of the two-step release process, in the event of a crash, release from the front unit is only brought about once the ski boot has rotated through a predetermined angle as far as a stop. Subsequently, a second, sudden resistance occurs so as to allow the front unit to be released. So as to ensure a reliable release in the second step, by way of the inertia force between the boot and the binding, the holding force of the holding means of the front unit must not exceed a predetermined force. On the other hand, under some circumstances a correspondingly lower holding force can lead to erroneous releases of the front unit during sporting travel or in the event of exceptional loads during ascent in touring mode.

Thus, in accordance with the first aspect, the object of the invention is to provide a front unit of the type mentioned at the outset comprising a pivotable holding means, in which reliable release properties are ensured, and at the same time the binding provides a sufficiently high holding force on the front unit in normal operation so as to prevent erroneous releases.

In accordance with the first aspect, to achieve this object the invention provides a front unit of the type mentioned at the outset, in which a release arrangement is further provided which converts a relative movement of the holding means and the base (that is to say a rotation of the holding means about the vertical axis with respect to the base) into an adjustment movement of the holding means from the engagement position into a release position.

Thus, according to the invention, rather than the boot being released from the front unit (in particular in the event of a crash) in a two-step process, in which the holding means only opens when a predetermined angle of rotation is exceeded, in particular by way of a sudden stop, the rotational movement itself is instead converted into the opening movement of the holding means, in such a way that the opening process is a direct consequence of the rotational movement. This ensures that, during or after the release of the heel unit, the front holding unit also opens and releases the sliding board boot. Since the rotational movement itself is converted into the opening movement of the holding means, that is to say the holding means is necessarily opened in the event of the rotational movement, the holding means of the front unit can be set up so as to hold the boot in place with a relatively high holding force in the normal operating position, preventing erroneous releases.

The conversion of the rotational movement of the holding means into an opening movement of the holding means can be implemented by way of a control cam mechanism, in such a way that the rotational movement necessarily leads to an opening movement which takes place simultaneously. The movement is thus converted using simple means and also in a highly reliable manner.

In a preferred embodiment, it is provided that the base comprises a cam portion and that the holding means comprises a cam follower which is pressed into contact with the cam portion by a force of a tensioning means, a movement of the cam follower counter to the force of the tensioning means bringing about the adjustment movement of the holding means from the engagement position into the release position. In this embodiment, by shaping the cam portion or the cam follower accordingly, a movement sequence during the opening of the holding means can be defined precisely and reliably. In this context, the cam portion may have a V-shaped or U-shaped control contour on which the cam follower slides during a relative rotation of the holding means and the base. Control contours of this type may in particular be formed symmetrically, in such a way that a neutral position or normal position, in which the boot is orientated in the longitudinal direction of the sliding board, can be defined at the lowest point of the V shape or U shape. The holding means can be rotated out of this normal position in either rotational direction in the event of release, the cam follower sliding on one of the two limbs of the V shape or U shape in this case, in particular counter to the resistance of the tensioning means.

In accordance with a second aspect, the present invention relates to a front unit for a sliding board binding, comprising a base, which is set up for fastening to a sliding board, and a left engagement element and a right engagement element, which are each held on bearing portions, in such a way that they are movable between an engagement position for holding a sliding board boot and a release position for releasing a sliding board boot, the engagement elements comprising coupling means, which are set up for coupling to front left and front right counter coupling means of a sliding board boot, in a portion remote from the bearing portions, and the coupling means defining a transverse axis, about which a sliding board boot held on the coupling means can be pivoted, extending transverse to a longitudinal axis of the sliding board.

Front units of this type are known in the prior art, for example from EP 0 199 098 A and EP 2 431 080 A1. In this context, the coupling means are generally formed by left and right coupling pins, which are arranged on free ends of movably mounted engagement elements so as to face one another and be able to engage in corresponding left and right holes in the front part of the sliding board boot. In this known binding, the engagement elements, the bearing portions thereof on the base, and the coupling means have to be manufactured with sufficient stability, since they have to hold the front part of the sliding board boot reliably engaged even during descent. The forces acting on the engagement elements and the bearing portions thereof during use may lead to wear on the bearing portions over time, or require the use of particularly stable, but therefore relatively heavy components.

In accordance with a second aspect of the present invention, the object of the present invention is to provide a front unit for a sliding board binding of the aforementioned type which can exhibit less wear or a lower weight and/or is configured for high loads during normal operation.

According to the invention, this object is achieved by a front unit for a sliding board binding, in particular a touring binding of the aforementioned type, in which the front unit comprises at least one relief portion against which a support portion of the left and/or right engagement element, at a distance from the bearing portion, is supported in the engagement position.

The features of the invention in accordance with the second aspect achieve the effect whereby, on at least one of the two engagement elements, at least in the engagement position when high forces may act on the binding (for example during descent), part of the forces can be received by the relief portion, in such a way that the bearing portion or other parts of the engagement element can be relieved. In particular in the case of a lever-shaped engagement element, in which the coupling means is located at a free end at a distance from the bearing portion, supporting the engagement element on a relief portion between the bearing portion and the coupling means can lead to a significant reduction in the effective lever lengths when force is introduced from the coupling means.

In a particularly simple embodiment of the invention in accordance with the second aspect, the relief portion may be provided on the base. The force received by the relief portion can thus be introduced directly into the base, which is fastened to the sliding board. If the bearing portions of the engagement elements are formed on a base body, which is held on the base so as to be rotatable about a vertical axis, the relief portion is preferably also provided on the base body.

Particularly preferably, the support portion of the left and right engagement elements and the relief portion are set up for support in the vertical direction. During descent, high forces, in particular acting in the vertical direction and sometimes occurring in the manner of impulses, can be dissipated from the coupling means in a stable manner via the corresponding engagement element, the support portion and the relief portion according to the invention.

If the support portion of the engagement element and the relief portion are positively engaged with one another in the engagement position, in such a way that they are set up for support in at least two different directions, the relief portion according to the invention makes it possible to receive forces in at least two different directions, for example vertically upwards and vertically downwards. In this way, additional relief of the bearing portions and engagement elements is achieved.

A simple option for constructionally implementing a relief portion of the type according to the invention and optionally also supporting different support directions is offered by providing a projection which engages in a matching recess. In this way, one portion out of the support portion and the relief portion may comprise a projection and the other portion out of the support portion and the relief portion may comprise a recess for receiving the projection. By matching the contours of the projection and the recess appropriately, forces can thus be received in a positive fit in different directions.

Advantageously, a front unit in accordance with the second aspect may also be a front unit in accordance with the first aspect of the invention, and in particular comprise one or more of the features disclosed above in connection with the first aspect of the invention, so as to achieve the corresponding advantages and effects.

In accordance with a third aspect, the present invention relates to a front unit for a sliding board binding, comprising a base, which is set up for fastening to a sliding board, and a left engagement element and a right engagement element, which are each held on bearing portions on the base, in such a way that they can be moved between an engagement portion for holding a sliding board boot and a release position for releasing a sliding board boot, the engagement elements being biased into the engagement position by a tensioning element which is held movably with respect to the base.

A front unit of this type is known in the prior art, for example from EP 1 990 098 A and EP 2 431 080 A1. In this widely encountered binding, the two engagement elements each carry a gripping body, the gripping bodies of the two engagement elements lying against one another and being pressed against one another by respective springs. During the movement of the engagement elements between the open and the closed position, the coupling bodies slide against one another and bias the engagement elements into the open position or into the closed position.

The mechanism for biasing the engagement elements of the known touring binding is of a relatively complicated construction, and is susceptible to wear or other influences, such as moisture, snow and ice, as a result of the frictional contact between the two coupling bodies.

In addition, in the known front unit a total of four tension springs are used so as to bias the two coupling means towards one another without the risk of them canting with respect to one another.

In accordance with the third aspect, the object of the invention is to provide a front unit of the aforementioned type which comprises a mechanism, for moving the engagement elements between the open position and the closed position, which has a reduced tendency towards wear and is of a simple construction.

In accordance with the third aspect of the present invention, this object is achieved by a front unit of the aforementioned type which further comprises: a left connecting member, which on the one hand is pivotably connected to the left engagement element and on the other hand is pivotably connected to the tensioning element, and a right connecting member, which on the one hand is pivotably connected to the right engagement element and on the other hand is pivotably connected to the tensioning element.

Thus, according to the invention, instead of the two coupling bodies which are each biased by springs and are biased into contact with one another, a front unit in accordance with the third aspect of the invention comprises a left and a right connecting member, which are each pivotably coupled to the engagement elements associated therewith and are also pivotably connected to a tensioning element. As a result, on the one hand it is achieved that the two engagement elements can be biased by way of a shared tensioning element, in such a way that the number of spring means can be reduced, and on the other hand, all of the connections between the engagement elements and the tensioning element can be implemented by way of simple rotary bearings, for example pin bearings, in such a way that stable, low-wear movement conversion between the pivoting movement of the engagement elements and the movement of the tensioning element is made possible. In particular, contact bodies, cam mechanisms or the like which slide on one another, which are susceptible to external influences such as moisture, snow and ice, can be dispensed with.

In a particularly preferred embodiment of the third aspect of the invention, it is provided that at least one of the two engagement elements is mounted on the associated bearing portion thereof so as to be pivotable about a first pivot point, that the same engagement element is mounted on the associated connecting member thereof so as to be pivotable about a second pivot point, and that the same connecting member is mounted on the tensioning element so as to be pivotable about a third pivot point, an angle between a movement path of the tensioning element and a line interconnecting the second pivot point and the third pivot point being substantially a right angle, and an angle between the line interconnecting the second pivot point and the third pivot point and a line interconnecting the first pivot point and the second pivot point being substantially a right angle, in the engagement position. As a result of the features of this embodiment, the engagement elements are locked with automatic jamming in the engagement position (closed position) of the front unit, since, when a force is introduced from the boot into the engagement element and a torque is thus generated in the engagement element about the first pivot point of the associated bearing portion, this torque cannot generate any force components in the direction of movement of the tensioning element. Undesired release of the front unit can thus be prevented in the engagement position during normal use and even when particularly high forces act in the case of sporting travel or exceptional loads during ascent. At the same time, the force of the tensioning element can be limited to a relatively small force, in such a way that manual adjustment of the binding between the open position and the closed position is comfortably possible.

It is further conceivable to use the self-jamming configuration of the connecting members and the engagement elements in accordance with the aforementioned embodiment for locking the front unit in a travel position or touring position of the front unit, that is to say when it is fundamentally undesirable for the front unit to be released. By way of an additional mechanism or an additional adjustment actuation, the front unit can be adjusted from the touring position into a downhill position, in which the self-jamming configuration is overridden, for example the angles between the elements or movement paths are less than or greater than 90°, in such a way that in the downhill position it is made possible for the binding to release in the event of a crash. Alternatively, an additional release mechanism may be provided which ensures, in the downhill position, that the engagement elements release the sliding board boot in the event of a crash.

Advantageously, a front unit in accordance with the third aspect may also be a front unit in accordance with the first and/or second aspect of the invention, and in particular comprise one or more of the features disclosed above in connection with the first and/or second aspect of the invention so as to achieve the corresponding advantages and effects.

In accordance with a fourth aspect, the present invention relates to a front unit for a sliding board binding, comprising a holding arrangement, for holding a sliding board boot on the sliding board binding in an engagement position in such a way that the sliding board boot is pivotable in a defined pivot region, between a horizontal position substantially parallel to a sliding board plane and an inclined position at an angle to the sliding board plane, about an axis extending transverse to a longitudinal axis of the sliding board, and an actuation arrangement, for adjusting the holding arrangement between the engagement position and a release position in which the sliding board boot is substantially released from the holding engagement of the holding arrangement. The angle at which the sliding board boot (in particular a sole plane of the boot) is inclined with respect to the sliding board plane in the inclined position may be between approximately 60 degrees and approximately 90 degrees.

A front unit of this type is known for example from EP 1 990 098 A, and is part of a touring binding for holding the sliding board boot pivotably on the front unit in a touring mode. The known binding comprises an adjustment mechanism so as to adjust the holding means between a closed engagement position and an open release position. The adjustment mechanism simultaneously forms a release mechanism so as to release the sliding board boot in the event of a crash when a force acting laterally between the boot and the binding (torque about the vertical Z-axis) exceeds a predetermined release force.

A further known front unit is disclosed in EP 2 431 080 A1 and comprises a holding arrangement for holding a sliding board boot, the holding arrangement being mounted on a base, which is fixed to the sliding board, so as to be rotatable about a vertical axis. In this known front unit, an Mz release mechanism is implemented by way of cooperation with a heel unit, the heel portion of the boot being released laterally from the heel unit in a first phase of the release process, and the sliding board boot subsequently pivoting laterally about the shared vertical axis together with the holding means of the front unit, and finally, once a stop has been reached, the tensioning force of the holding means of the front unit being overcome in a known manner so as also to release the sliding board boot from the front unit.

In the touring bindings known in the prior art, release mechanisms are provided predominantly for an Mz release, so as to prevent the sliding board from rotating about the axis of the user's leg in the event of a crash. However, if a force acts in a vertical direction, and in particular if the ski boot rotates about a Y-axis extending transverse to the longitudinal axis of the sliding board, the touring bindings on the front unit do not release, since in this case, although the heel unit of the binding does release the heel portion of the ski boot upwards in the vertical direction, the boot subsequently pivots about the pivot axis of the holding means of the front unit. In this case, this does not result directly in a dangerous lever action between the sliding board and the user's leg, but complete release of the sliding board from the boot is still desired in the event of a crash, so as to remove the sliding board from the user as rapidly and reliably as possible in a situation of this type, and for example to prevent the front portion of the sliding board from striking the user's body.

Thus, in accordance with the fourth aspect, the object of the present invention is to provide a front unit of the aforementioned type, that is to say a front unit of a touring binding, which comprises an My release mechanism which releases the sliding board boot from the front unit when a force between the boot and the front unit, in the context of rotation about a transverse axis extending transverse to the longitudinal axis of the sliding board, exceeds a predetermined My release force.

According to the invention, this object is achieved by a front unit of a touring binding in which the actuation arrangement for adjusting the holding arrangement between an engagement position and a release position comprises an actuation element which is arranged in the pivot region of the sliding board boot, in such a way that a sliding board boot which is held in the engagement position contacts the actuation element during a pivoting movement in a direction from the horizontal position to the inclined position and actuates it to adjust the holding arrangement into the release position.

Thus, in accordance with the fourth aspect of the invention, an actuation element for opening the holding arrangement is arranged in the pivot region of the sliding board boot and is actuated by the sliding board boot once the sliding board boot has pivoted far enough forwards about the transverse axis. Thus, in a downhill position of the touring binding, an My release mechanism can be provided in which, when a corresponding torque acts about a Y axis in the event of a crash, the heel portion of the boot is initially released upwards from the heel unit of the binding in a manner known per se, and the boot subsequently pivots upwards towards the inclined position, and on this path actuates the actuation element. As a result, the holding arrangement is adjusted into the release position and the boot is fully released from the touring binding.

In principle, the actuation element could be arranged in such a way that the sliding board boot can only actuate the actuation element after exceeding a very large pivot angle and virtually reaching the vertical position, in such a way that during a normal pivoting movement in the touring position, during ascent, the actuation element is not actuated and the boot is held in place on the holding means. This variant has the advantage that no further adjustment of the front unit is required for activating the My release mechanism in the downhill position or deactivating the My mechanism in the touring position.

However, so as to ensure reliable engagement in the touring position and prevent erroneous releases during travel, in a preferred embodiment of the invention in accordance with the fourth aspect, it is conceivable for the front unit to be adjustable between a downhill position, in which the actuation element of the actuation arrangement is arranged in the pivot region, and a touring position, in which the actuation element of the actuation arrangement is arranged outside the pivot region. This embodiment can particularly advantageously be developed in that the front unit comprises a release mechanism, the release mechanism being adjusted or adjustable into an active position in the downhill position, in such a way that when a force exceeding a predetermined release force acts between the sliding board boot and the front unit, the holding arrangement is adjusted into the release position so as to release the sliding board boot from the front unit, the release mechanism being adjusted or adjustable into a locked position in the touring position, in such a way that the sliding board boot is prevented from being released, adjustment of the actuation element from the downhill position into the touring position causing the release mechanism to be adjusted from the active position into the locked position. Thus, the adjustment between the downhill position and the touring position may not only move the actuation element according to the invention into the appropriate position, but also simultaneously adjust a release mechanism, in particular an Mz and/or Mx release mechanism, between an active and passive position, in such a way that in the release position the desired release mechanisms are active in each case and in the touring position substantially no release mechanisms which could cause erroneous releases during travel are in operation.

Figure 4A:
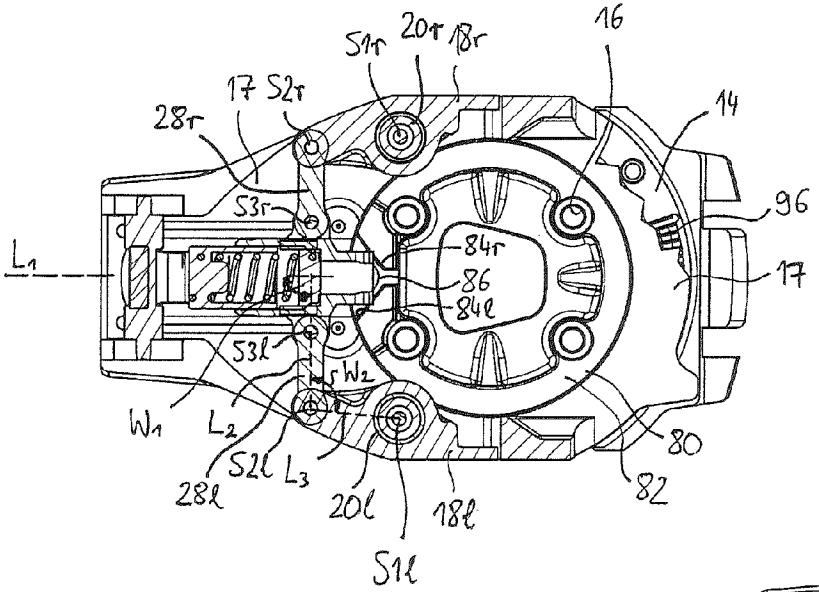
Figure 4B:
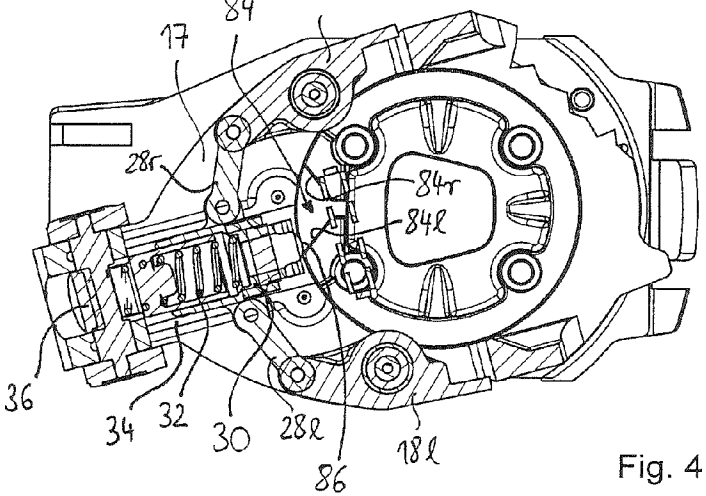

The invention is described in greater detail in the following by way of a preferred embodiment, referring to the appended drawings, in which:

FIG. 1*a* is a side view of a front unit of the embodiment of the present invention in a release position and a partial view of a front portion of a ski boot, FIG. 1*b* is a perspective view of the front unit of the embodiment, FIG. 1*c* is a plan view of the front unit of the embodiment, FIG. 1*d* is a perspective sectional view of the front unit of the embodiment along a section line A-A in FIG. 1*c*, FIG. 1*e* is a sectional view of the front unit of the embodiment along a section line A-A in FIG. 1*c*, FIGS. 2*a* to 2*e* are views of the front unit of the embodiment corresponding to the views in FIG. 1*a* to 1*e*, but for a downhill position of the front unit, FIGS. 3*a* to 3*e* are views of the front unit of the embodiment corresponding to the views in FIGS. 1*a* to 1*e*, but for a touring position of the front unit, and FIGS. 4*a* and 4*b* are sectional views of the front unit of the embodiment along a section line B-B in FIG. 2*a*.

A front unit, generally denoted as 10 in the drawings, of the embodiment of the invention is basically set up as a front part of a touring binding so as to pivotably hold a ski boot 12 at a front boot portion. The front unit comprises a base 14, which is provided for fastening to a touring ski and may in particular comprise fastening holes 16 (FIG. 4*a*) for this purpose.

The fastening arrangement of the base 14, for fastening to the sliding board, defines a sliding board plane E corresponding to the surface of the sliding board on which the base 14 is to be mounted. In a coordinate system of the front unit, an X direction extends parallel to the sliding board plane E and along a longitudinal axis L of the sliding board. A Y direction (horizontal in the lateral direction) extends orthogonal to the X direction and likewise parallel to the sliding board plane E. A Z direction of the coordinate system of the front unit 10 extends vertically upwards, that is to say orthogonal to the X direction and to the Y direction.

A holding arrangement for holding the ski boot 12 is arranged on the base 14. In the embodiment, the holding arrangement is held on the base 14 so as to be rotatable about an axis V, and comprises a base body 17 which is mounted on the base 14 so as to be rotatable about the axis V. The holding arrangement is arranged on the base body 17 together with a left engagement element 18*l* and a right engagement element 18*r*, which are mounted pivotably on the base by bearing portions 20*l*, 20*r* respectively. In the embodiment, the engagement elements 18*l*, 18*r* are rotatable about vertical (pointing in the Z direction) axes S1*l*, S1*r* respectively. At a distance from the bearing portions 20*l*, 20*r*, the engagement elements 18*l*, 18*r* carry coupling means 22*l*, 22*r* respectively, which are set up so as to engage with matching counter coupling means 24*l*, 24*r* on front left and front right lateral portions of a sole 26 of the ski boot 12, so as to hold the boot 12 on the front unit 10 rotatably about a transverse axis Q, which is defined by the two coupling means 22*l*, 22*r* and extends transverse to the X direction (in particular in the Y direction).

On the left engagement element 18*l*, a left connecting member 28*l* is mounted so as to be pivotable on a left second pivot axis S2*l*, which is located at a distance from the left first pivot axis S1*l*. Analogously, a right connecting member 28*r* is mounted so as to be pivotable on a right second pivot axis S2*r* on the right engagement element 18*r*, the second right pivot axis S2*r* also being located at a distance from the right first pivot axis S1*r*. At a distance from the second pivot axes S2*l*, S2*r*, the connecting members 28*l*, 28*r* are each pivotably coupled to a tensioning element 30. This coupling may be provided at a shared pivot point. In the embodiment, however, the left connecting member 28*l* is articulated to the tensioning element 30 so as to be pivotable on a left third pivot axis S3*l*, and the right connecting member 28*r* is articulated to the tensioning element 30 so as to be pivotable on a right third pivot axis S3*r*, the left and right third pivot axes S3*l*, S3*r* each being at a distance from one another and from the left and right second pivot axes S2*l*, S2*r*. Preferably, the pivot axes S1*l*, S1*r*, S2*l*, S2*r* and S3*l*, S3*r* all extend mutually parallel, in particular in the Z direction.

The tensioning element 30 may be held on the front unit 10 so as to be displaceable in the X direction and is biased in a displacement direction (in this case rearwards or towards the boot 12) by a spring element 32. Preferably, the tensioning element 30 is in the form of a piston, which is held displaceably on a piston guide 34, which is fastened to the base body 17. The front end of the spring 32 which biases the tensioning element 30 may be supported on a spring bearing 36 of the piston guide 34, and the rear end of the spring may be supported on the tensioning element 30. The spring bearing 36 may be held in threaded engagement on the piston guide 34, for example being in the form of a screw which is screwed into the piston guide 34, in such a way that the bias of the spring 32 can be set by rotating the spring bearing 36.

By way of the above-disclosed arrangement of the engagement elements 18*l*, 18*r*, the connecting members 28*l*, 28*r* and the tensioning element 30, a pivoting movement of the engagement elements 18*l*, 18*r* between a closed position and an open position can be converted into a linear displacement movement of the tensioning element 30. Conversely, displacement of the tensioning element 30 brings about a pivoting movement of the engagement elements 18*l*, 18*r* between the engagement position and the release position.

The holding arrangement further comprises an adjustment element 38, which can act on the tensioning element 30 so as to displace the tensioning element 30 counter to the force of the spring 32 in such a way that the engagement elements 18*l*, 18*r* are adjusted into the release position. The adjustment element 38 may in particular be operated manually by the user, for example by exerting a compressive force using a ski pole, and the adjustment element 38 may comprise an operating portion comprising a corresponding depression 40 for this purpose. The adjustment element 38 may be held pivotably on the base body 17, and comprise a latching portion 42, which slides on a control contour 44 of the tensioning element 30 when the adjustment element 38 moves, in such a way that the movement of the adjustment element 38 is converted into displacement of the tensioning element 30 counter to the force of the spring 32. In an end portion of the control contour 44, a counter latching portion 46 of the tensioning element 30 may latch onto the latching portion 42 of the adjustment element 38, in such a way that the adjustment element 38 continues to hold the tensioning element 30 back without any force being exerted by the user, and the engagement elements 18*l*, 18*r* are held in the open position. As can be seen in the drawings, the latching portion 42 may be formed by a projection which latches into a depression which forms the counter latching portion 46.

An entry element 48 is further held movably on the base body 17, and comprises a pedal portion 50 for actuation by compression by a lower sole portion of a ski boot 12, in such a way that, as a result of actuation of this type by compression by the boot 12, the entry element 48 is moved upon entry into the front unit 10. An unlocking portion 52 of the entry element 48 may be connected to the adjustment element 38 in such a way that movement of the entry element 48, as a result of a compressive force being exerted on the pedal portion 50 by the boot 12, releases the latch portion 42 of the adjustment element 38 from the counter latching portion 46 of the tensioning element 30, in such a way that the tensioning element 30 is displaced by the force of the spring 32 and the engagement elements 18*l*, 18*r* pivot into the engagement position. In the embodiment, the entry element 48 is mounted on the base body 17 so as to be pivotable on a pivot axis 54 pointing in the Y direction, in such a way that an upward movement of the unlocking portion 52 can be produced by way of an downwardly (arrow 55) acting compressive force from the ski boot 12, so as to lift the adjustment element 38 upwards and thus release the tensioning element 30.

The holding means may further comprise a release lever 56 for providing an My release mechanism. The release lever 56 can be attached to the base body 17 so as to be pivotable about a pivot axis 57 pointing in the Y direction, and be set up in such a way that a lower contact portion 58 of the release lever 56 can be supported on an upper contact portion 60 of the adjustment element 38, in such a way that when a compressive force is exerted on the release lever 56 downwards in the Z direction and the release lever 56 pivots downwards, the adjustment element 38 moves downwards, resulting in the tensioning element 30 being urged counter to the force of the spring 32 and the engagement elements 18*l*, 18*r* being pivoted from the engagement position towards the release position.

The release lever 56 preferably comprises an actuation portion 60 which is arranged in a pivot region M of the boot 12 with respect to a pivoting movement of the boot 12 about the transverse axis Q of the coupling means 22*l*, 22*r*. In other words, in the downhill position of the front unit 10 (for example FIGS. 2*a* to 2*e*), the actuation portion 60 of the release lever 56 is positioned in such a way that, when the boot 12 pivots forwards about the transverse axis Q, a front face 62 of the boot 12 strikes the actuation portion 60 from above and presses the release lever 56 downwards as the pivoting movement continues, and thus opens the holding means and releases the boot 12 in the above-disclosed manner. Since sliding board boots which are set up and provided for use with a front unit of the type presently under discussion, in particular touring ski boots which are already known per se, are of a largely standardised shape in the region of the toe, in particular so as to make coupling possible to the coupling pins (coupling means 22*l*, 22*r*) which are known per se, the position of the release portion 60 and the pivot region of the release lever 56 can be selected appropriately by a person skilled in the art so as to ensure reliable actuation of the release mechanism, when the boot 12 pivots forwards, by way of boots of this type.

The front unit 10 of the embodiment of the invention may further relieve at least one of the two engagement elements 18*l*, 18*r* by way of a relief portion. In the illustrated example, a left relief portion 64*l*, on which the left engagement element 18*l* can be supported vertically upwards and downwards, is provided on the base body 17, and a right relief portion 64*r*, on which the right engagement element 18*r* can be supported vertically upwards and downwards, is fastened to the base body 17. In the following, only the left relief portion 64*l* is representatively disclosed in greater detail, it also being possible to provide the disclosed features analogously for the support on the right relief portion 64*r*.

The left relief portion 64*l* comprises an upper relief face 66*o*, on which a lower support face 68*u* of the left engagement element 18*l* can be supported, and further comprises a lower relief face 66*u*, on which an upper support face 68*o* of the left engagement element 18*l* can be supported, in such a way that forces acting on the engagement element 18*l* both vertically upwards and vertically downwards can be introduced into the relief portion in a stable manner. In this context, the upper and lower support faces 68*o*, 68*u* are arranged in a portion of the engagement element 18*l* which is located between the bearing portion 20*l* and the coupling means 22*l*.

Preferably, the above-disclosed relief is provided by way of a projection engaging positively in a matching recess. As can be seen in FIG. 2*a*, the left relief portion 64*l* and the corresponding region of the left engagement element 18*l* engage positively in one another, in such a way that vertical forces can be received in a stable manner. In particular, a projection 70 of the relief portion 64*l* can engage in a matching recess 72 of the engagement element 18*l* and/or a projection 74 of the engagement element 18*l* can engage in a matching recess 76 of the relief portion 64*l*. The respective upper and lower support faces or relief faces preferably extend parallel to the sliding board plane E, in such a way that the pivoting movement of the engagement element 18*l* is not obstructed, and the corresponding adjacent faces slide on one another even during this pivoting movement, and the relief functionality is provided even in intermediate states between the engagement position and the release position.

The rotary coupling between the base body 17 and the base 14 is described in greater detail in the following, referring in particular to FIGS. 4*a* and 4*b*.

As is already known per se from EP 2 431 080 A1, the base body 17 comprises a plate-shaped portion comprising a circular bearing clearance 78 (FIG. 3*e*), the edge portion of the bearing clearance 78 being held under a peripheral edge portion 80 of a bearing disc 82 which is to be fastened to the ski or to the base 14, in such a way that the base body 17 cannot be lifted from the sliding board or from the base part 14, but is held so as to be rotatable about the central axis of rotation V, which extends in the Z direction and passes through the centre of the bearing clearance 78. Since the holding arrangement—including the engagement element 18*l*, 18*r*, the tensioning element 30 and the other components coupled to these elements—is held directly or indirectly on the base body 17, the holding arrangement can rotate about the axis of rotation V together with a boot 12 which may be held in place thereby.

In accordance with a further feature of an aspect of the present invention, the rotational movement of the holding arrangement about the axis V is converted into an opening movement of the engagement element 18*l*, 184, so as to provide a reliable Mz release. The control cam mechanism which is to be disclosed in the following may be used for this purpose. In the embodiment, the control cam mechanism comprises a cam portion 84, which is formed on the bearing disc 82 fixed to the base and which comprises a left cam face 84*l* and a right cam face 84*r*, which may each be configured in a straight line and may in particular extend symmetrically in a V shape with respect to the longitudinal axis L of the sliding board. A cam follower 86, which is held movably on the base body 17 and is preferably biased by spring force into contact with the cam portion, cooperates with the cam portion 84. Preferably, the above-disclosed tensioning element 30 may comprise the cam follower 86, in such a way that the spring means 32 can be used for biasing the cam follower 86. The cam follower 86 may in particular be a projection on the rear end of the tensioning element 30.

The contour of the cam portion 84 defines a neutral position in accordance with FIG. 4*a* for the rotation of the base body 17 about the axis V, the cam follower 86 being arranged at the lowest point of the contour of the cam portion 84 in the neutral position, and the cam follower 86 having to run on one of the two cam faces 84*l*, 84*r* of the cam portion 84 during a pivoting movement of the base body 17 out of the neutral position in the two respective rotational directions, and being urged back counter to the force of the spring which biases the cam follower 86. The base body 17 is thus rotated out of the neutral position counter to the resistance of a resilient restoration force. In this context, the neutral position is the normal travel position, in which a ski boot 12 held on the holding arrangement is orientated in the direction of the longitudinal axis L of the sliding board.

The front unit 10 of the embodiment of the present invention may further comprise a rotary locking mechanism, which prevents the base body 17, and thus the holding arrangement, from rotating about the axis of rotation V in a touring position of the front unit 10. Particularly advantageously, in the embodiment of the present invention, the release lever 56 can be used for producing rotary locking of this type. As can be seen in particular in FIG. 3, the release lever 56 can be adjusted forwards about the pivot axis 57 thereof, by way of manual actuation by a user, until a rotary locking portion 88 of the release lever 56 engages with an associated rotary locking portion 90 of the base part 14 or of the sliding board, in such a way that lateral movement between the release lever 56 and the base part 14 or sliding board is blocked, and rotary locking of the base body 17 is thus achieved. For example, the rotary locking portion 88 of the release lever 56 may engage in a matching clearance 92 of the base part 14, so as to ensure positive blocking in both directions of rotation using simple means. At the same time, as a result of the release lever 56 pivoting forwards for rotational locking, the actuation portion 60 of the release lever 56 is also removed from the pivot region of the ski boot 12, in such a way that, in the touring position thus produced, actuation of the release lever 56 by the boot 12 is prevented, and undesired opening of the holding arrangement in the touring position can thus be prevented.

A mode of operation of the front unit of the embodiment of the invention is described in greater detail in the following.

In the release position shown in FIGS. 1*a* to 1*e* of the front unit 10, the tensioning element 30 is displaced forwards counter to the force of the spring means 32 and is held in place in this position by way of engagement of the latching portion 42 with the counter latching portion 46. The engagement elements 18*l*, 18*r* are pivoted into the open position, in such a way that the coupling means 22*l*, 22*r* are at a sufficiently large distance from one another for the ski boot 12 to be inserted between the coupling means 22*l*, 22*r*. The release lever 56 is folded back, in such a way that the actuation portion 60 is arranged in the vicinity of the ski boot 12. A rear edge portion 94 of the release lever 56 may in particular be positioned in such a way that it serves as a stop or at least as an orientation for the ski boot 12, so as to arrange the ski boot 12 in an appropriate position, in such a way that the counter coupling means 24*l*, 24*r* of the ski boot 12 are positioned ready for engagement opposite the coupling means 22*l*, 22*r*.

For entry into the front unit 10, the user exerts a compressive force on the pedal portion 50 of the entry element 48 in the direction of the arrow 55 in FIG. 1*e*, via the ski boot 12, whereupon the entry element 48 moves the adjustment element 38, in particular lifts it, in such a way that the latching portion 42 is released from the counter latching portion 46. Subsequently, the adjustment element 38 is no longer holding the tensioning element 30 in the forwardly displaced position, and so the tensioning element 30 is displaced rearwards by the force of the spring means 32. In this context, the latching portion 42 slides upwards along the control contour 44 and lifts the adjustment element 38 into an upper position. Simultaneously with the rearward movement of the tensioning element 30, the left and right connecting members 28*l*, 28*r*, which are articulated to the tensioning element 30, are pivoted, resulting in the engagement elements 18*l*, 18*r* finally being pivoted in such a way that the coupling means 22*l*, 22*r* move towards the counter coupling means 24*l*, 24*r* of the ski boot 12, and in particular the pins 22*l*, 22*r* penetrate into the clearances 24*l*, 24*r* in the boot.

When the coupling means 22*l*, 22*r* are lying against the counter coupling means 24*l*, 24*r*, the engagement position shown in FIGS. 2*a* to 2*e* and in FIG. 4*a* is produced. In this engagement position, the tensioning element 30, the connecting members 28*l*, 28*r* and the engagement elements 18*l*, 18*r* form a self-jamming lock, which blocks undesired adjustment of the holding arrangement into the release position. To describe this locking, a movement path of the tensioning element 30, extending along the longitudinal axis L of the sliding board, is denoted as $L_1$, a line interconnecting the left second pivot axis S2*l* and the left third pivot axis S3*l* is denoted as $L_2$, and a line interconnecting the left second pivot axis S2*l* and the left first pivot axis S1*l* is denoted as $L_3$. As can be seen in FIG. 4*a*, in the engagement position the angle $W_1$ between the line $L_1$ and the line $L_2$ is approximately a right angle and the angle $W_2$ between the line $L_2$ and the line $L_3$ is likewise substantially a right angle. In the engagement position of the front unit 10, corresponding right angles are set analogously between $L_1$ and a line interconnecting the right third pivot axis S3*r* and the right second pivot axis S2*r* and between said connecting line and a line interconnecting the right second pivot axis S2*r* and the right first pivot axis S1*r*. As a result of these right angles, no rotary forces act on the connecting members 28*l*, 28*r* when force acts on the coupling means 22*l*, 22*r*, in such a way that the tensioning element 30 is not displaced and thus a movement of the elements of the holding arrangement towards the release position is blocked.

As can be seen in particular in FIG. 4*a*, the cam follower 86 does not quite reach contact with the cam portion 84 at the rear end of the tensioning element 30. Instead, a small gap or play is left between the cam follower 86 and the cam portion 84. This play ensures that the coupling means 22*l*, 22*r* are pressed against the counter coupling means 24*l*, 24*r* of the ski boot 12 by the spring tension originating from the spring 32, and are still held securely in contact even in the event of manufacturing tolerances or wear. If said play between the cam follower 86 and the cam portion 84 is provided, an additional centring mechanism 96 may preferably be provided, which ensures that the base body 17 is biased towards the neutral position, that is to say is effective in an angular range in which a centring effect by way of the control cam mechanism 84, 86 is not effective as a result of said play between the cam follower 86 and the cam portion 84. The additional centring mechanism 96 can be provided by way of two relatively weak springs 98 which bias the base body 17 in opposite directions, in such a way that when the base body 17 is deflected out of the neutral position, one or other of the springs is compressed and urges the base body back to the neutral position.

In the engagement position in accordance with FIGS. 2*a* to 2*e*, the front unit 10 can be used for downhill travel. In this context, a heel portion of the ski boot 12 can be held in place by a heel unit (not shown) of the touring binding. In a downhill position of this type, the front unit 10 of the embodiment provides an My release mechanism and an Mz release mechanism. When a large force acts, in the context of rotation about the Z axis (for example in the event of a crash), the heel unit releases laterally and the ski boot 12 pivots on the base body 16 about the vertical axis V together with the holding arrangement. In this context, the cam follower 86 slides on one of the two control faces 84*l*, 84*r* of the cam portion 84, in such a way that the tensioning element 30 is displaced forwards counter to the force of the spring means 32. In this context, the tensioning element 30 pivots the connecting members 28*l*, 28*r* and therefore also the engagement elements 18*l*, 18*r* towards the release position. Thus, simultaneously with the release of the heel unit, there is also a continuous opening movement of the holding arrangement towards the release position, in such a way that the ski boot is released both at the heel and at the front boot portion and is reliably decoupled from the binding.

In an My release, the heel unit (not shown) of the touring binding releases the heel portion of the ski boot 12 vertically upwards when a force exceeding a predetermined release force acts on the ski boot in the context of a rotational movement about the Y axis (for example during a crash). In this case, the ski boot 12 rotates upwards about the transverse axis Q of the coupling means 22*l*, 22*r* towards a vertical position of the ski boot, until the front face 62 of the ski boot 12 contacts the actuation portion 60 of the release lever 56 from above. As the pivoting movement of the ski boot 12 continues, the release lever 56 is pressed downwards, in such a way that the adjustment element 38 is also moved downwards. As a result of the latching portion 42 sliding on the control contour 44, the tensioning element 30 is displaced forwards counter to the force of the spring means 32 during this movement, and adjusts the engagement elements 18*l*, 18*r* into the release position in the above-disclosed manner, in such a way that the ski boot 12 is released by the front unit 10.

To adjust the touring binding into a touring position, a heel unit (not shown) of the touring binding can be adjusted in such a way that it releases the heel unit of the ski boot 12, in such a way that the ski boot 12 can pivot freely about the transverse axis Q. Further, to adjust the front unit 10 into the touring position, the release lever 56 can be folded forwards until it is supported on the base part 14 or on the sliding board. In this context, in particular the rotary locking portion 88 of the release lever 56 enters locking engagement with the corresponding rotary locking portion 90 on the base part 14 or on the sliding board, in such a way that rotation of the base body 17 about the axis V is blocked. Further, as a result of the release lever 56 folding forwards, the actuation portion 60 is arranged outside the pivot region M of the ski boot 12, in such a way that the ski boot 12 can pivot forwards freely without the release lever 56 being actuated.

For exiting the front unit 10, the user can move the front unit 10 out of the touring position, and also out of the downhill position, into the release position. For this purpose, the user can exert a compressive force on the adjustment element 38 by means of a ski pole or in some other manner. Alternatively, in the downhill position of the front unit 10 the user can exert a compressive force on the release lever 56. As a result of the downward movement of the adjustment element 38 which is thus brought about, the tensioning element 30 is displaced forwards in the above-disclosed manner, and the engagement elements 18*l*, 18*r* are moved into the release position until the locking portion 42 latches together with the counter latching portion 46 and the holding arrangement is locked in the release position. The coupling means 22*l*, 22*r* are subsequently sufficiently far apart for the engagement thereof to be released from the counter coupling means 24*l*, 24*r* and for the ski boot 12 to be lifted out of the front unit 10.

The invention claimed is:

1. A front unit for a sliding board binding, comprising:

a base, which is configured to be fastened to a sliding board and which defines a sliding board plane, and;

a holding means configured to hold a front portion of a sliding board boot, wherein the holding means is mounted rotatably on the base such that both the holding means and the sliding board boot are rotatable about a shared vertical axis, extending substantially orthogonal to the sliding board plane, in an engagement position of the holding means, and a release arrangement which converts a relative movement between the holding means and the base about the shared vertical axis into an adjustment movement of the holding means from the engagement position into a release position.

2. The front unit according to claim 1, wherein the release arrangement comprises a control cam mechanism.

3. The front unit according to claim 1, wherein the base comprises a cam portion and wherein the holding means comprises a cam follower which is pressed into contact with the cam portion by a force of a tensioning means, and wherein a movement of the cam follower counter to the force of the tensioning means brings about the adjustment movement of the holding means from the engagement position into the release position.

4. The front unit according to claim 3, wherein the cam portion has a V-shaped or U-shaped control contour on which the cam follower slides during a relative rotation of the holding means and the base.

5. A front unit for a sliding board binding, comprising:

a base, which is configured to be fastened to a sliding board, and a left engagement element and a right engagement element, which are each held on bearing portions, such that the left and right engagement elements are movable between an engagement position for holding a sliding board boot and a release position for releasing a sliding board boot, wherein the left and right engagement elements comprise coupling means, which are configured to couple to a front left and a front right counter coupling means of a sliding board boot, in a portion remote from the bearing portions, and wherein the coupling means define a transverse axis, which extends transverse to a longitudinal axis of a sliding board, and wherein the sliding board boot is pivotable about the traverse axis when the sliding board boot is held by the coupling means, and at least one relief portion against which a support portion of the left and/or right engagement element, at a distance from the bearing portions, is supported in the engagement position.

6. The front unit according to claim 5, wherein the relief portion is provided on the base or on a base body which carries the bearing portions.

7. The front unit according to claim 5, wherein the support portion and the relief portion are configured for support in the vertical direction.

8. The front unit according to claim 5, wherein the support portion and the relief portion are positively engaged with one another in the engagement position, such that the support portion and the relief portion are configured for support in at least two different directions.

9. The front unit according to claim 5, wherein one portion out of the support portion and the relief portion comprises a projection and the other portion out of the support portion and the relief portion comprises a recess for receiving the projection.

10. A front unit for a sliding board binding, comprising:

a base, which is configured to be fastened to a sliding board, and a left engagement element and a right engagement element, which are each held on bearing portions, such that the left engagement element and the right engagement element are movable between an engagement position for holding a sliding board boot and a release position for releasing a sliding board boot, wherein the engagement elements are biased into the engagement position by a tensioning element which is held movably with respect to the base;

a left connecting member, which on the one end is pivotably connected to the left engagement element and on the other end is pivotably connected to the tensioning element; and a right connecting member, which on the one end is pivotably connected to the right engagement element and on the other end is pivotably connected to the tensioning element.

11. The front unit according to claim 10, wherein at least one of the two engagement elements is mounted on the associated bearing portion thereof so as to be pivotable about a first pivot point, and wherein the same engagement element is mounted on the associated connecting member thereof so as to be pivotable about a second pivot point, and wherein the same connecting member is mounted on the tensioning element so as to be pivotable about a third pivot point, wherein in the engagement position, an angle between a movement path of the tensioning element and a line interconnecting the second pivot point and the third pivot point is substantially a right angle, and wherein an angle between the line interconnecting the second pivot point and the third pivot point and a line interconnecting the first pivot point and the second pivot point is substantially a right angle.

12. A front unit for a sliding board binding, comprising:

a holding arrangement, configured to hold the sliding board boot on the sliding board binding in an engagement position of the holding arrangement in such a way that the sliding board boot is pivotable in a defined pivot region, between a horizontal position substantially parallel to a sliding board plane and an inclined position at an oblique angle to the sliding board plane, about an axis extending transverse to a longitudinal axis of a sliding board;

an actuation arrangement, for adjusting the holding arrangement between the engagement position and a release position of the holding arrangement in which the sliding board boot is substantially released from the holding engagement of the holding arrangement, wherein the actuation arrangement comprises an actuation element which is arranged in the pivot region, and wherein the actuation element is contactable and actuatable by the sliding board boot when the sliding board boot is held in the engagement position, during a pivoting movement in a direction from the horizontal position to the inclined position, wherein actuation of the actuation element adjusts the holding arrangement into the release position, and wherein the front unit is adjustable between a downhill position, in which the actuation element of the actuation arrangement is arranged in the pivot region, and a touring position, in which the actuation element of the actuation arrangement is arranged outside the pivot region.

13. The front unit according to claim 12, further comprising:

a release mechanism, wherein the release mechanism is adjustable into an active position in the downhill position, such that when a force exceeding a predetermined release force acts between the sliding board boot and the front unit, the holding arrangement is adjusted into the release position so as to release the sliding board boot from the front unit, wherein the release mechanism is adjustable into a locked position in the touring position, such that the sliding board boot is prevented from being released, and wherein adjustment of the actuation element from the downhill position into the touring position causes the release mechanism to be adjusted from the active position into the locked position.

14. The front unit according to claim 1, wherein in a downhill position, the front unit is configured to hold the sliding board boot pivotably about a substantially vertical axis.

* * * * *